US011410794B2

(12) United States Patent
Maioli et al.

(10) Patent No.: US 11,410,794 B2
(45) Date of Patent: Aug. 9, 2022

(54) ARMOURED CABLE FOR TRANSPORTING ALTERNATE CURRENT WITH PERMANENTLY MAGNETISED ARMOUR WIRES

(71) Applicant: Prysmian S.p.A., Milan (IT)

(72) Inventors: Paolo Maioli, Milan (IT); Marco Ruzzier, Milan (IT); Monica Lucarelli, Milan (IT)

(73) Assignee: PRYSMIAN S.p.A., Milan (IT)

( * ) Notice: Subject to any disclaimer, the term of this patent is extended or adjusted under 35 U.S.C. 154(b) by 0 days.

(21) Appl. No.: 17/056,968

(22) PCT Filed: May 24, 2018

(86) PCT No.: PCT/EP2018/063709

§ 371 (c)(1),
(2) Date: Nov. 19, 2020

(87) PCT Pub. No.: WO2019/223875

PCT Pub. Date: Nov. 28, 2019

(65) Prior Publication Data

US 2021/0183537 A1 Jun. 17, 2021

(51) Int. Cl.
*H01B 7/26* (2006.01)
*H01B 7/14* (2006.01)

(52) U.S. Cl.
CPC ..... *H01B 7/26* (2013.01); *H01B 7/14* (2013.01)

(58) Field of Classification Search
CPC ..... H01B 7/14; H01B 7/26
See application file for complete search history.

(56) References Cited

U.S. PATENT DOCUMENTS 1,603,875 A * 10/1926 Shanklin ..... H01B 9/025 174/36
2,041,147 A * 5/1936 Preisach ..... H01F 1/00 178/45

(Continued)

FOREIGN PATENT DOCUMENTS

WO WO 00/63927 A1 10/2000
WO WO 2013/174399 A1 11/2013
WO WO2018/192666 A1 10/2018

OTHER PUBLICATIONS

Hughes et al., "The Economics and Benefits of Cable Magnetization", Jan. 2001, 5 pages, XP055549413, https:P/www3utechcom/sites/3utechcom/fles/Maqnetizer%2001 pdf. (Year: 2001).*

(Continued)

*Primary Examiner* — William H. Mayo, III
*Assistant Examiner* — Rhadames Alonzo Miller
(74) *Attorney, Agent, or Firm* — Finnegan, Henderson, Farabow, Garrett & Dunner, L.L.P.

(57) ABSTRACT

The present disclosure relates to an armoured AC cable comprising at least one core comprising an electric conductor, and an armour surrounding the at least one core and comprising ferromagnetic wires, wherein the ferromagnetic wires are permanently magnetized with a remanent magnetic field which is uniform or variable along the cable length L. The present disclosure also relates to a process for producing an armoured AC cable, a method for improving the performances of an armoured AC cable, and a method for reducing losses in an armoured AC cable.

16 Claims, 5 Drawing Sheets

(56) References Cited

U.S. PATENT DOCUMENTS 5,305,410 A * 4/1994 Arroyo ..... G02B 6/447 385/100
5,305,411 A * 4/1994 Arroyo ..... G02B 6/447 385/109
5,426,716 A * 6/1995 Arroyo ..... G01V 15/00 385/100
5,546,672 A * 8/1996 Campbell ..... G01B 7/046 33/708
5,577,147 A * 11/1996 Arroyo ..... G02B 6/447 385/109
5,713,415 A * 2/1998 Bridges ..... E21B 36/04 166/60
6,037,767 A * 3/2000 Crescenzo ..... G01N 27/82 324/220
6,366,191 B1 * 4/2002 Cloutier ..... G02B 6/447 335/302
6,369,679 B1 * 4/2002 Cloutier ..... G02B 6/447 335/284
8,051,912 B2 * 11/2011 Layton ..... E21B 17/028 166/369
9,431,153 B2 8/2016 Maioli et al.
2002/0027014 A1 * 3/2002 Mukoyama ..... H01B 12/02 174/125.1
2003/0024728 A1 * 2/2003 Yamamoto ..... H01B 11/203 174/113 R
2004/0200637 A1 * 10/2004 Yumura ..... H01B 12/06 174/125.1
2006/0048966 A1 * 3/2006 Takahashi ..... H01B 11/1025 174/108
2011/0139485 A1 * 6/2011 Matsuda ..... H01P 3/02 174/102 R
2011/0247856 A1 * 10/2011 Matsuda ..... H01B 11/203 174/108
2014/0166335 A1 * 6/2014 Kagoura ..... H01B 7/2825 174/107
2015/0170795 A1 * 6/2015 Maioli ..... H01B 7/26 174/108
2016/0111184 A1 * 4/2016 Gogola ..... H01B 7/22 174/130
2016/0172077 A1 * 6/2016 Maioli ..... H01B 7/04 174/108
2017/0198530 A1 * 7/2017 McFarland ..... G01D 5/02
2018/0226176 A1 * 8/2018 Marelli ..... H01B 7/1875
2019/0066873 A1 * 2/2019 Kaneda ..... H01B 9/02
2019/0318841 A1 * 10/2019 Hornung ..... H05K 9/0098

OTHER PUBLICATIONS

International Search Report form the European Patent Office in corresponding International Application No. PCT/EP2018/063709, dated Feb. 13, 2019.

Written Opinion of the International Searching Authority from the European Patent Office in corresponding International Application No. PCT/EP2018/063709, dated Feb. 13, 2019.

Hughes et al., "The Economics and Benefits of Cable Magnetization", Jan. 2001, 5 pages, XP055549413, https://www_3utech.com/sites/3utech_com/files/Magnetizer2001.pdf.

Innovatum Product Reference Manuals, "Section 2 Magnetic submarine cable & Pipeline survey systems Theory of Operations", Nov. 2012, 28 pages, SP055549427, http://www.innovatum.co.uk/media/1963/section_2_theory_of_operation-_issue_2.pdf.

International Standard IEC 60287-1-1 (Second Edition, 2006) (71 pages in both English and French).

Office Action dated Sep. 24, 2021, from the European Patent Office issued in counterpart European Application No. 18728823.8 (7 pages).

* cited by examiner

ARMOURED CABLE FOR TRANSPORTING ALTERNATE CURRENT WITH PERMANENTLY MAGNETISED ARMOUR WIRES

This application is a national phase application based on PCT/EP2018/063709, filed May 24, 2018, the content of which is incorporated herein by reference.

The present disclosure relates to an armoured electrical cable for transporting alternate current (AC). The disclosure also relates to a process for producing an armoured AC cable, a method for reducing losses in said armoured AC cable and to a method for improving the performances of an armoured AC cable.

An armoured cable is generally employed in application where mechanical stresses are envisaged. In an armoured AC cable, the cable core or cores (typically three stranded cores, in the latter case) are surrounded by at least one armour layer in the form of metal wires, configured to strengthen the cable structure while maintaining a suitable flexibility. Each cable core comprises an electric conductor in the form of a rod or of stranded wires, and an insulating system (comprising an inner semiconductive layer, an insulating layer and an outer semiconductive layer), which can be individually or collectively screened by a metal screen. The metal screen can be made, for example, of lead, generally in form of an extruded layer, or of copper, in form of a longitudinally wrapped foil, of wounded tapes or of braided wires. When alternate current is transported into a cable, the temperature of the electric conductors within the cable cores rises due to resistive losses, a phenomenon referred to as Joule effect.

The transported alternate current and the electric conductors are typically sized in order to guarantee that the maximum temperature in electric conductors is maintained below a prefixed threshold (e.g., below 90° C.) that guarantees the integrity of the cable.

The international standard IEC 60287-1-1 (second edition 2006-12) provides methods for calculating permissible current rating of cables from details of permissible temperature rise, conductor resistance, losses and thermal resistivities. In particular, the calculation of the current rating in electric cables is applicable to the conditions of the steady-state operation at all alternating voltages. The term "steady state" is intended to mean a continuous constant current (100% load factor) just sufficient to produce asymptotically the maximum conductor temperature, the surrounding ambient conditions being assumed constant. Formulae for the calculation of losses are also given.

In IEC 60287-1-1, the permissible current rating of an AC cable is derived from the expression for the permissible conductor temperature rise AO above ambient temperature $\theta_a$, wherein $\Delta\theta=\theta-\theta_a$, $\theta$ being the conductor temperature when a current I is flowing into the conductor and $\theta_a$ being the temperature of the surrounding medium under normal conditions, at a situation in which cables are installed, or are to be installed, including the effect of any local source of heat, but not the increase of temperature in the immediate neighbourhood of the cables to heat arising therefrom. For example, the conductor temperature $\theta$ should be kept lower than about 90° C.

For example, according to IEC 60287-1-1, in case of buried AC cables where drying out of the soil does not occur or AC cables in air, the permissible current rating can be derived from the expression for the temperature rise above ambient temperature:

$$I=\left[\frac{\Delta\theta-W_d\cdot[0.5\cdot T_1+n\cdot(T_2+T_3+T_4)]}{R\cdot T_1+n\cdot R\cdot(1+\lambda_1)\cdot T_2+n\cdot R\cdot(1+\lambda_1+\lambda_2)\cdot(T_3+T_4)}\right]^{0.5} \quad (1)$$

where:

I is the current flowing in one conductor (Ampere)

$\Delta\theta$ is the conductor temperature rise above the ambient temperature (Kelvin)

R is the alternating current resistance per unit length of the conductor at maximum operating temperature (Ω/m);

$W_d$ is the dielectric loss per unit length for the insulation surrounding the conductor (W/m);

$T_1$ is the thermal resistance per unit length between one conductor and the sheath (K·m/W);

$T_2$ is the thermal resistance per unit length of the bedding between sheath and armour (K·m/W);

$T_3$ is the thermal resistance per unit length of the external serving of the cable (K·m/W);

$T_4$ is the thermal resistance per unit length between the cable surface and the surrounding medium (K·m/W);

n is the number of load-carrying conductors in the cable (conductors of equal size and carrying the same load);

$\lambda_1$ is the ratio of losses in the metal screen to total losses in all conductors in that cable;

$\lambda_2$ is the ratio of losses in the armouring to total losses in all conductors in the cable.

In case of three-core cables and steel wire armour, the ratio $\lambda_2$ is given, in IEC 60287-1-1, by the following formula:

$$\lambda_2=1.23\frac{R_A}{R}\left(\frac{2c}{d_A}\right)^2\frac{1}{\left(\frac{2.77R_A10^6}{\omega}\right)^2+1} \quad (2)$$

where $R_A$ is the AC resistance of armour at maximum armour temperature (Ω/m);

R is the alternating current resistance per unit length of conductor at maximum operating temperature (Ω/m);

$d_A$ is the mean diameter of armour (mm);

c is the distance between the axis of a conductor and the cable centre (mm);

ω is the angular frequency of the current in the conductors.

The Applicant has observed that, in general, a reduction of losses in an armoured AC electric cable enables to increase the permissible current rating and, thus, to reduce the cross-section of the conductor(s) (thus, the cable size and the quantity of material necessary to make the cable) and/or to increase the amount of the current transported by the cable conductors (thus, the power carried by the cable).

The Applicant has investigated the losses in an armoured AC electric cable. In particular, the Applicant has investigated the losses in an armoured AC electric cable when part of the wires or all of the wires of the armour is made of ferromagnetic material, which is economically appealing with respect to a non-ferromagnetic material like, for example, austenitic stainless steel.

During its development activities, the Applicant has noted that losses are related to the variable magnetic field generated by AC current transported by the electric conductors, which causes eddy currents in the layers surrounding the cores (like, for example, the metal screen and the ferromagnetic wires of the armour) and magnetic hysteresis of the ferromagnetic wires of the armour.

During investigations of the losses in an armoured AC electrical cable, wherein the armour includes wires made of ferromagnetic material, the Applicant found that the provision of a permanent magnetization in the ferromagnetic wires of the armour enables to reduce hysteresis and eddy current losses in the cable, in particular in the ferromagnetic armour wires and metal screen (compared with a similar cable having only its natural magnetization, e.g. due to the earth's magnetic field).

Magnetization of cables is known, specifically in the optical cable field.

U.S. Pat. No. 6,366,191 discloses a method for providing permanent magnetic signature in ferromagnetic material (e.g. strength or armour members) of fibre optic buried cables to facilitate their long-range location magnetically. In particular, this document teaches to magnetize the ferromagnetic material of the fibre optic cables so as to produce a radial external "leakage" magnetic field around the cable that is substantially cylindrically symmetric and that varies periodically along the length of the cable.

In a first aspect the present disclosure relates to an armoured AC cable having a cable length L, comprising:

at least one core comprising an electric conductor;

an armour surrounding the at least one core and comprising ferromagnetic wires;

wherein the ferromagnetic wires are permanently magnetized with a remanent magnetic field.

In a second aspect the present disclosure relates to a process for producing an armoured AC cable comprising at least one core comprising an electric conductor, and an armour surrounding the at least one core, the armour comprising ferromagnetic wires, the process comprising permanently magnetizing said ferromagnetic wires so as to generate in the wires a remanent magnetic field.

In a third aspect the present disclosure relates to a method for improving the performances of an armoured AC cable having a cable length L and cable losses when an alternate current I is transported, the armoured AC cable comprising at least one core comprising an electric conductor having a cross section area X sized for operating the cable to transport an alternate current I at a maximum allowable working conductor temperature θ, as determined by the cable losses; the armoured AC cable further comprising an armour, surrounding the at least one core and comprising ferromagnetic wires; the method comprising the steps of:

reducing the cable losses by permanently magnetizing the ferromagnetic wires so as to generate in the wires a remanent magnetic field;

sizing the cross section area X of each electric conductor with a reduced value, this reduced value being determined and made possible by the value of the reduced cable losses, and/or rating the armoured AC cable at the maximum allowable working conductor temperature θ to transport said alternate current I with an increased value, this increased value being determined and made possible by the value of the reduced cable losses.

In a fourth aspect the present disclosure relates to a method for reducing losses in an armoured AC cable comprising at least one core comprising an electric conductor, and an armour surrounding the at least one core, the armour comprising ferromagnetic wires, the method comprising permanently magnetizing the ferromagnetic wires so as to generate in the wires a remanent magnetic field.

In a further aspect the present disclosure relates to an armoured AC cable having a cable length L and cable losses when an alternate current I is transported, comprising:

at least one core, each core comprising an electric conductor having a cross section area X sized for operating the cable to transport an alternate current I at a maximum allowable working conductor temperature θ, as determined by the cable losses, and an armour surrounding the at least one core and comprising ferromagnetic wires permanently magnetized with a remanent magnetic field, whereby the cable losses are reduced, wherein:

the cross section area X of each electric conductor is sized with a reduced value, this reduced value being determined and made possible by the value of the reduced armour losses, and/or the armoured AC cable is rated to operate at the maximum allowable working conductor temperature θ to transport said alternate current I with an increased value, this increased value being determined and made possible by the value of the reduced cable losses.

Thanks to the Applicant's finding that cable losses are reduced by a permanent magnetization of the ferromagnetic armour wires of an armoured AC cable, the performances of the armoured AC cable can be improved in terms of increased transported alternate current and/or reduced electric conductor cross section area X.

In the cable market, a cable is offered for sale or sold accompanied by indication relating to, inter alia, the amount of transported alternate current, the cross-section area X of the electric conductor/s and the maximum allowable working conductor temperature. Thanks to the Applicant's finding, a permanently magnetized armoured AC cable according to the present disclosure can have a reduced cross section area of the electric conductor/s with substantially the same amount of transported alternate current and maximum allowable working conductor temperature, and/or an increased amount of transported alternate current with substantially the same cross section area of the electric conductor/s and maximum allowable working conductor temperature.

This enables to make an armoured AC cable with increased current capacity and/or to reduce the size of the conductors with consequent reduction of cable size, weight and cost.

In the present disclosure, the remanent magnetic field generated in the ferromagnetic wires of the cable can be either uniform or variable along the cable length L.

In the present disclosure and claims as "variable" it is meant a magnetic field varying according to a pattern, not necessarily regular, possibly designed on a cable configuration, as it will be exemplified in the following.

In the present description and claims, the expressions "to permanently magnetize" or "permanent magnetization" in relation to ferromagnetic wires is used to indicate the act of applying an external magnetic field to the ferromagnetic wires so that a remanent magnetization is retained by them after the external magnetic field is removed.

The remanent magnetization can be retained by the ferromagnetic wires for a long time (e.g. tens or hundreds of years) without appreciable reduction.

In particular, the remanent magnetization can be retained by the ferromagnetic wires for a long time unless the ferromagnetic wires are subjected to a specific demagnetizing force. The demagnetizing force could be of about 3 kA/m, while the magnetic field generated by the cable transporting an AC current is of about 0.3 kA/m, thus far from a suitable demagnetization force.

In an embodiment, the step of permanently magnetizing the ferromagnetic wires is carried out by applying an external magnetic field to an extent such as to reach magnetic saturation of the ferromagnetic material of the wires.

The external magnetic field can be applied parallel to the cable axis or following the armour wires deposition pattern.

In the present description and claims, the expressions "magnetic saturation" is used to indicate a state reached by a material wherein an increase in an applied external magnetic field cannot substantially increase the magnetization of the material further.

In the present description and claims, the expressions "permanently magnetized" in relation to ferromagnetic wires is used to indicate the result of an operation of permanent magnetization applied to said wires. Permanently magnetized ferromagnetic wires according to the present disclosure and claims have been subjected to a permanent magnetization and have a remanent magnetic field, which may be either uniform or variable along the cable length L, depending on the kind of the external magnetic field applied thereto during the permanent magnetization process, i.e. uniform or variable along the cable length L.

In the present description and claims, the term "core" is used to indicate an electric conductor surrounded by an insulating layer and, optionally, at least one semiconducting layer. The core can further comprise a metal screen surrounding the conductor, the insulating layer and the semiconducting layer/s.

In the present description and claims, the term "ferromagnetic" indicates a material which has a substantial susceptibility to magnetization by an external magnetizing field (the strength of magnetization depending on that of the applied magnetizing field), and which remains at least partially magnetized after removal of the applied field. For example, the term "ferromagnetic" indicates a material that, below a given temperature, has a relative magnetic permeability significantly greater than 1, for example greater than 100.

In the present description, the term "non-ferromagnetic" indicates a material that below a given temperature has a relative magnetic permeability of about 1.

In the present description and claims, the term "maximum allowable working conductor temperature" is used to indicate the highest temperature a conductor is allowed to reach in operation in a steady state condition, in order to guarantee integrity of the cable. The temperature reached by the cable in operation substantially depends on the overall cable losses, including conductor losses due to the Joule effect and dissipative phenomena. The losses in the armour and in the metal screen are another significant component of the overall cable losses.

In the present description and claims, the term "permissible current rating" is used to indicate the maximum current that can be transported in an electric conductor in order to guarantee that the electric conductor temperature does not exceed the maximum allowable working conductor temperature in steady state condition. Steady state is reached when the rate of heat generation in the cable is equal to the rate of heat dissipation from the surface of the cable, according to laying conditions.

In the present description and claims, the term "cable length" is used to indicate the length of a cable between two ends.

In the present description and claims, the term "section" indicates a portion of the cable length having a given core stranding direction and armour winding direction.

In the present description and claims, the terms "armour winding direction" and "armour winding pitch" are used to indicate the winding direction and the winding pitch of the armour wires provided in one armour layer. When the armour comprises more than one layer of wires, the term "armour winding direction" and "armour winding pitch" are used to indicate the winding direction and winding pitch of the armour wires provided in the innermost layer.

In case of a multi-core armoured AC cable, in the present description and claims, the term "unilay" is used to indicate that the stranding of the cores and the winding of the wires of an armour layer have a same direction (for example, both left-handed or both right-handed), with a same or different pitch in absolute value.

In the present description and claims, the term "contralay" is used to indicate that the stranding of the cores and the winding of the wires of an armour layer have an opposite direction (for example, one left-handed and the other one right-handed), with a same or different pitch in absolute value.

In the present description and claims, the term "crossing pitch C" is used to indicate the length of cable taken by the wires of the armour to make a single complete turn around the cable cores. The crossing pitch C is given by the following relationship:

$$C = \left| \frac{1}{\frac{1}{A} - \frac{1}{B}} \right|$$

wherein A is the core stranding pitch and B is the armour winding pitch. A is positive when the cores stranded together turn right (right screw or, in other words, are right-handed) and B is positive when the armour wires wound around the cable turn right (right screw or, in other words, right-handed). The value of C is always positive. When the values of A and B are very similar (both in modulus and sign) the value of C becomes very large.

In the present description and claims, the term "recurrently reversed along the cable length" in relation to a core stranding direction and an armour winding direction is used to indicate that the direction is reversed along the cable length more than one time so as to have at least three consecutive sections having stranding and/or winding direction opposite one another.

In the present description and claims, the term "regularly reversed along the cable length" in relation to a core stranding direction and an armour winding direction is used to indicate that the direction is reversed along the cable length in conformity with a predetermined rule.

The present disclosure, in at least one of the aforementioned aspects, can be implemented according to one or more of the following embodiments, optionally combined together.

In an embodiment, the remanent magnetic field generated in the ferromagnetic wires of the cable is periodically variable along the cable length L.

In an embodiment, the cable losses are reduced by at least 1%; for example up to 5% or more depending on the conductor/s cross section and the kind of material used for the armour wires. In particular, the losses are reduced compared to a similar cable not subjected to any permanent magnetization of the ferromagnetic armour wires (that is, to a similar cable having ferromagnetic armour wires with their natural magnetization only, e.g. due to the earth's magnetic field).

Suitably, the remanent magnetization of the ferromagnetic wires is stronger than any natural magnetization of the ferromagnetic wires by earth's magnetic field, which is generally of 65 μT (microTesla) at most.

In an embodiment, the ferromagnetic wires are permanently magnetized by applying an external magnetic field to the AC cable as a whole.

The external magnetic field can be applied to the AC cable during the laying process or manufacturing process of the AC cable.

The external magnetic field may be produced by DC or AC electromagnets, solenoids or by permanent magnets (e.g. rare earth magnets).

In an embodiment, the external magnetic field is of the order of thousands of A/m. For example, the external magnetic field is of the order of tens of thousands of A/m.

In an embodiment, the external magnetic field is applied so as to reach magnetic saturation of the ferromagnetic material of the ferromagnetic wires. Magnetization values in the vicinity of the magnetic saturation can be suitable as well for the scope of the present description.

The external magnetic field applied to the ferromagnetic wires of the cable of the disclosure can be uniform (i.e. constant) or variable along the cable length L. Accordingly, the remanent magnetization retained by the ferromagnetic wires after the external magnetic field is removed is, respectively, uniform or variable along the cable length L.

In an embodiment, the periodical variation of the external magnetic field and, accordingly, of the remanent magnetic field can be, for example, sinusoidal. Harmonics can be added to change the shape of the sinusoid curve.

In an embodiment, the armour comprises only ferromagnetic wires.

In another embodiment, the armour also comprises non-ferromagnetic wires. The non-ferromagnetic wires can be circumferentially intermingled with the ferromagnetic wires.

The ferromagnetic material of the ferromagnetic wires can be selected from: construction steel, ferritic stainless steel, martensitic stainless steel and carbon steel, optionally galvanized.

In an embodiment, the non-ferromagnetic material of the non-ferromagnetic wires is selected from: polymeric material and stainless steel.

In an embodiment, at least some of the ferromagnetic wires are made of a ferromagnetic core surrounded by a non-ferromagnetic material.

In an embodiment, at least some of the ferromagnetic wires are made of a ferromagnetic core surrounded by an electrically conductive, non-ferromagnetic material.

The electric conductor can be in the form of a rod or of stranded wires. In an embodiment, the electric conductor is sequentially surrounded by an inner semiconductive layer, an insulating layer and an outer semiconductive layer.

The electric conductor can be made of a conductive material like, for example, copper, aluminium or both.

In an embodiment, the armoured AC cable comprises two or more cores.

Suitably, said cores are stranded together according to a core stranding direction.

Suitably, said cores are helically stranded together.

Suitably, the cores are stranded together according to a core stranding pitch A.

In an embodiment, the armour surrounds the cores by a layer of wires, including the ferromagnetic wires, helically wound around the cores according to an armour winding direction.

In an embodiment, the core stranding direction and the armour winding direction are unilay.

In an alternative embodiment, the core stranding direction and the armour winding direction are contralay.

In another embodiment, at least one of the core stranding direction and the armour winding direction is recurrently reversed along the cable length L so that the armoured cable comprises unilay sections along the cable length where the core stranding direction and the armour winding direction are the same.

As explained in PCT/EP2017/059482 in the name of the Applicant and the content of which is incorporated by reference, this embodiment is advantageous because recurrent reversions of the stranding direction of the cable cores and/or the winding direction of the armour wires along the cable length improve the cable mechanical performance (compared with a cable having a whole unilay configuration) and, at the same time, reduce hysteresis and eddy current losses in the cable (compared with a cable having a whole contralay configuration).

In an embodiment, the cable length L where at least one of the core stranding direction and the armour winding direction is recurrently reversed is that between two fixed points, each fixed point being, for example, a cable joint, the touch-down point on the seabed or the anchoring point on a deployment vessel.

In an embodiment, at least one of the core stranding direction and the armour winding direction is recurrently reversed along the cable length L so that unilay sections alternate along the cable length with contralay sections. In this way, in the unilay sections the core stranding direction and the armour winding direction are both left-handed or both right-handed, while in the contralay sections one is right-handed and the other one is left-handed.

In an embodiment, when the ferromagnetic wires are permanently magnetized with a remanent magnetic field, which is variable (in an embodiment, periodically variable) along the cable length L, the ferromagnetic wires are permanently magnetized so that any inversion point of the variable remanent magnetic field falls in said unilay sections, for example substantially at the centre of said unilay sections or at a distance from the unilay/contralay reversion point equivalent, for example, to the double of the cable diameter. This is advantageous considering that, at every inversion point of the (periodically) variable remanent magnetic field, the permanent magnetization is substantially reduced to zero, so that its beneficial effects on losses reduction are nullified at said inversion points. Similarly, when the remanent magnetic field is variable along the cable length L without inversion points but with peaks and valleys, it can be beneficial to have the ferromagnetic wires permanently magnetized so that valley points of the variable remanent magnetic field fall in said unilay sections. It is thus advantageous to have any inversion/valley points at the unilay sections (wherein, as disclosed by U.S. Pat. No. 9,431,153 and and PCT/EP2017/059482, the armour losses are lower than in the contralay sections), so as to have full benefit of losses reduction, due to permanent magnetization of the ferromagnetic wires, in the contralay sections.

In an embodiment, the remanent magnetic field has a periodic variation along the cable length L with a magnetization pitch which is substantially the same as the core stranding pitch A.

In an embodiment, at least one of the core stranding direction and the armour winding direction is regularly reversed along the cable length.

In an embodiment, at least one of the contralay sections comprises two different contralay sub-sections wherein the plurality of cores are stranded together with different core stranding pitches; and/or wherein the armour wires are wound around the cores with different armour winding pitches.

In an embodiment, only one of the core stranding direction and the armour winding direction is recurrently reversed. In another embodiment, only one of the core stranding direction and the armour winding direction is recurrently and regularly reversed along the cable length.

In an embodiment, the core stranding direction is recurrently, optionally regularly, reversed along the cable length, the armour winding direction being unchanged.

In an alternative embodiment, both the core stranding direction and the armour winding direction are recurrently (in an embodiment, regularly) reversed along the cable length. In this alternative embodiment, unilay sections can be obtained wherein the core stranding and the armour winding are in a first direction (e.g. left-handed), alternated with unilay sections wherein both the core stranding and the armour winding are in a second direction (e.g. right-handed). In this case, contralay sections can be present or absent.

The number of reversions of at least one of the core stranding direction and the armour winding direction depends upon the cable type and/or length L.

In an embodiment, the unilay sections along the cable length involve, as a whole, at least 20% of the cable length, for example at least 30% or at least 40% or at least 45% of the cable length.

In an embodiment, the unilay sections along the cable length involve, as a whole, no more than 80% of the cable length, for example no more than 70%, or no more than 60%, or no more than 55%.

In an embodiment, the unilay sections along the cable length L cover about 50% of the cable length L.

Suitably, at least one of the core stranding direction and the armour winding direction is recurrently reversed along the cable length L so that N is the number of consecutive turns of the core stranding and/or armour winding in a first direction (e.g. left-handed or S-lay) and M is the number of consecutive turns of the core stranding and/or armour winding in a second direction, reversed with respect to the first direction (e.g. right-handed or Z-lay, when the first direction is left-handed). In particular, N is the number of complete, consecutive turns in a unilay (or contralay) section of the plurality of cores and/or of the armour wires about the cable longitudinal axis, in the first direction. M is number of complete, consecutive turns in a unilay (or contralay) section of the plurality of cores and/or of the armour wires about the cable axis, in the second direction.

N and M can be integer or decimal numbers.

N can be the same or vary along the cable length L. In this way, the number N of turns can be the same or can vary in the different sections of the cable length L wherein at least one of the core stranding direction and the armour winding is equal to the first direction.

M can be the same or vary along the cable length. In this way, the number M of turns can be the same or can vary in different sections of the cable length wherein at least one of the core stranding direction and the armour winding is equal to the second direction.

The sum of N and M of two consecutive cable sections can be the same or vary with respect to other/s consecutive cable section/s along the cable length.

N can be equal to or different from M.

In an embodiment, $N \geq 1$, for example $N \geq 2.5$. In an embodiment, $N \leq 10$, for example $N \leq 5$ or $N \leq 4$.

In an embodiment, $M \geq 1$, for example $M \geq 2.5$. In an embodiment, $M \leq 10$, for example $M \leq 5$ or $M \leq 4$.

The core stranding pitch A, in modulus, can be the same or vary along the cable length L.

In an embodiment, the core stranding pitch A, in modulus, is of from 1000 to 3000 mm. For example, the core stranding pitch A, in modulus, is of from 1500 to 2600 mm. Low values of A can be economically disadvantageous as higher conductor length is necessary for a given cable length. On the other side, high values of A can be disadvantageous in term of cable flexibility.

Suitably, the armour wires are wound around the cores according to an armour winding pitch B.

The armour winding pitch B, in modulus, can be the same or vary along the cable length L.

In an embodiment, in the contralay sections, the armour winding pitch B is greater, in modulus, than the armour winding pitch B in the unilay sections. This advantageously enables to reduce losses in contralay sections.

In an embodiment, the armour winding pitch B, in modulus, is of from 1000 to 3000 mm. For example, the armour winding pitch B, in modulus, is of from 1500 to 2600 mm. Low values of B can be disadvantageous in terms of cable losses. On the other side, high values of B can be disadvantageous in terms of mechanical strength of the cable.

In an embodiment, the armour winding pitch B is higher than 0.4 A. For example, $B \geq 0.5$ A, or $B \geq 0.6$ A or $B \geq 0.75$ A. In an embodiment, the armour winding pitch B is smaller than 2.5 A. For example, the armour winding pitch B is smaller than 2 A, or smaller than 1.8 A, or smaller than 1.5 A.

In an embodiment, the armour winding pitch B is different (in sign and/or absolute value) from the core stranding pitch A ($B \neq A$). Such a difference is at least equal to 10% of pitch A. Though seemingly favourable in term of armouring loss reduction, the configuration with B=A (both in sign and absolute value) would be disadvantageous in terms of mechanical strength of the cable.

In the unilay sections, the crossing pitch C can be higher than the core stranding pitch A, in modulus. In an embodiment, $C \geq 2$ A, in modulus. For example, $C \geq 3$ A, in modulus; or $C \geq 5$ A, in modulus; or $C \geq 10$ A, in modulus. Suitably, C can be up to 12 A, in modulus.

In the contralay sections, the crossing pitch C is can be lower than the core stranding pitch A, in modulus. In an embodiment, $C \leq 2$ A, in modulus. For example, $C \leq 3$ A, in modulus; or $C \leq 5$ A, in modulus; or $C \leq 10$ A, in modulus.

The changing of the core stranding direction and/or of the armour winding direction causes a transition zone where the cores and/or the armour wires are parallel to the cable longitudinal axis. The transition zone/s can be from a half to one third of the core stranding pitch A and/or of the armour winding pitch B.

In an embodiment, each electric conductor is individually screened by a metal screen. The metal screen can be of copper in form of wires or rods or of lead in form of an extruded layer.

In an embodiment, the armour comprises a further layer of armour wires surrounding the layer of armour wires. The armour wires of the further layer are suitably wound around the cores according to a further layer winding direction and a further layer winding pitch B'. The armour wires of the further layer can be helicoidally wound around the cores.

In an embodiment, the further layer winding direction is opposite (contralay) with respect to the winding direction of the armour wires of the underlying layer.

This contralay configuration of the further layer is advantageous in terms of mechanical performances of the cable.

In an embodiment, the further layer winding pitch B' is lower, in absolute value, of the armour winding pitch B.

In an embodiment, the further layer winding pitch B' differs, in absolute value, from B by ±10% of B.

The armour wires can have polygonal or circular cross-section. In alternative, the armour wires can have an elongated cross section. In the case of an elongated cross-section, the cross-section major axis can be oriented tangentially with respect to a circumference enclosing the plurality of cores.

In case of circular cross-section, the armour wires can have a cross-section diameter of from 2 to 10 mm. For example, the diameter is of from 4 mm. For example, the diameter is not higher than 7 mm.

In an embodiment, the cores are each a single phase core. In another embodiment, the cores are multi-phase cores (that is, they have phases different to each other).

In an embodiment, the armoured AC cable comprises three cores. The cable can be a three-phase cable. The three-phase cable can comprise three single phase cores.

The armoured AC cable can be a low, medium or high voltage cable (LV, MV, HV, respectively). The term low voltage is used to indicate voltages lower than 1 kV. The term medium voltage is used to indicate voltages of from 1 to 35 kV. The term high voltage (HV) is used to indicate voltages higher than 35 kV.

The armoured AC cable may be terrestrial. The terrestrial cable can be at least in part buried or positioned in tunnels.

In an embodiment, the armoured AC cable is a submarine cable.

The features and advantages of the present disclosure will be made apparent by the following detailed description of some exemplary embodiments thereof, provided merely by way of non-limiting examples, description that will be conducted by making reference to the attached drawings, wherein:

FIG. 1 schematically shows an armoured cable according to an embodiment of the present disclosure;

Figure 3:
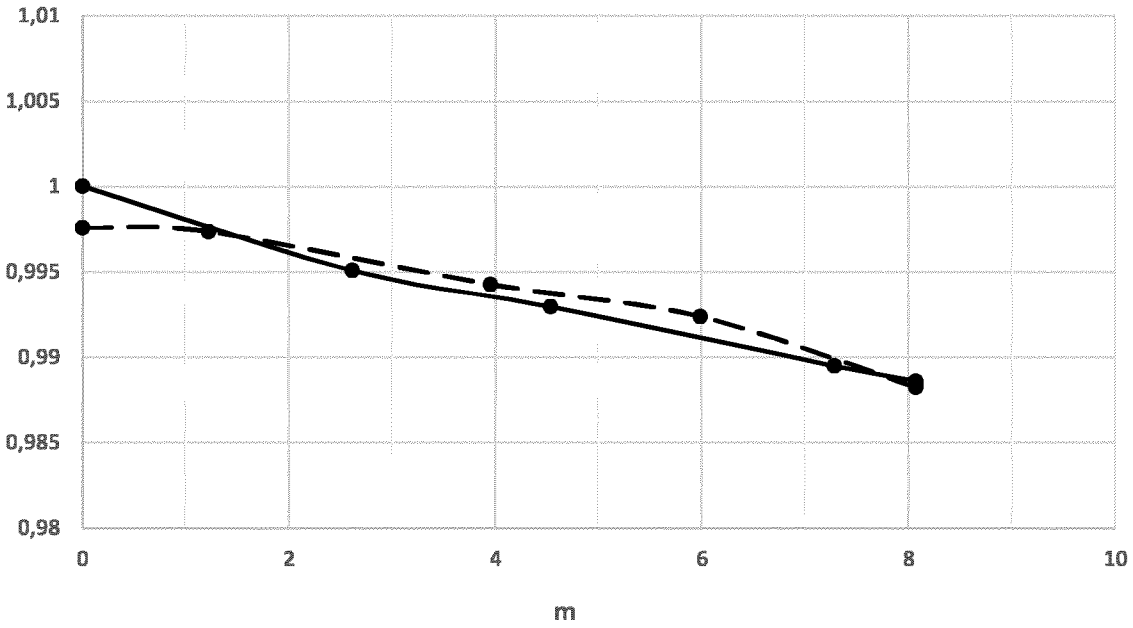
FIG. 3 shows the relative phase resistance measured during progressive magnetization and demagnetization of sections of an AC cable sample, with respect to the non-magnetized AC cable sample.
Figure 4:
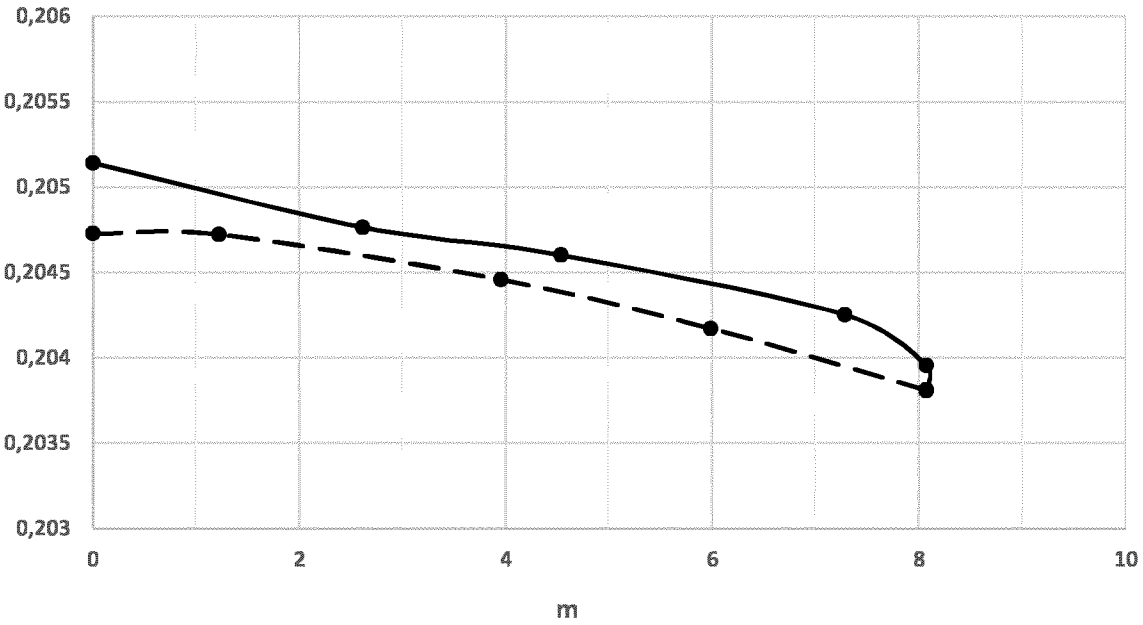
Figure 5:
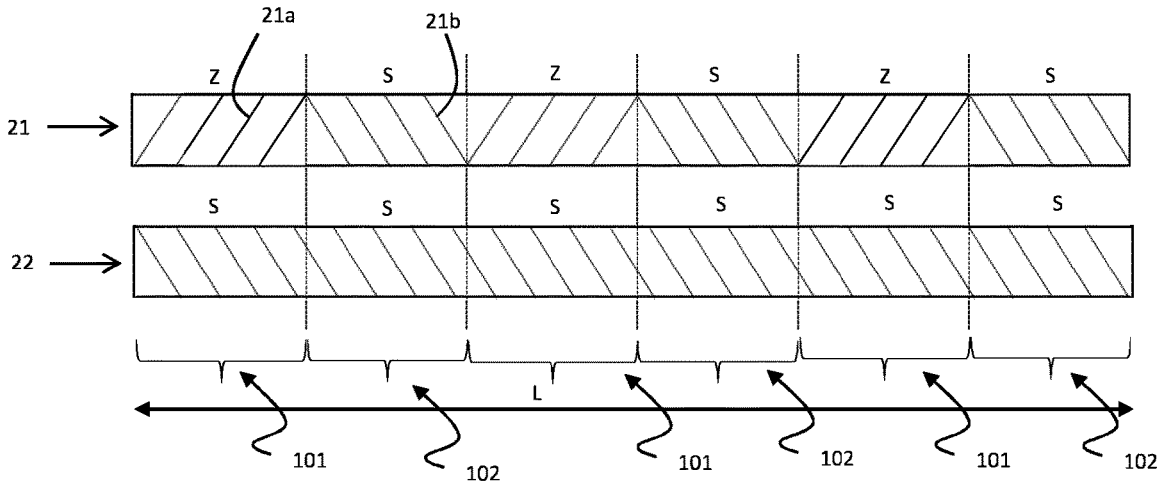
Figure 6:
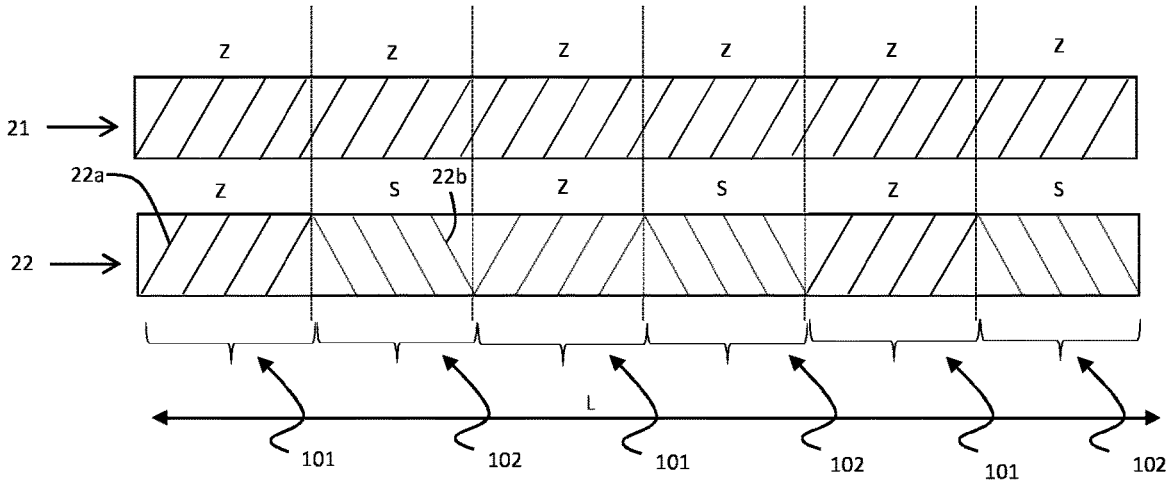

FIG. 4 the ratio $I_{screen}/I_{conductor}$, measured during progressive magnetization and demagnetization of sections of the AC cable sample of FIG. 3;

FIG. 5 schematically shows an embodiment of the present disclosure wherein the core stranding direction is regularly reversed along the cable length;

FIG. 6 schematically shows an embodiment of the present disclosure wherein the armour winding direction is regularly reversed along the cable length.

Figure 1:
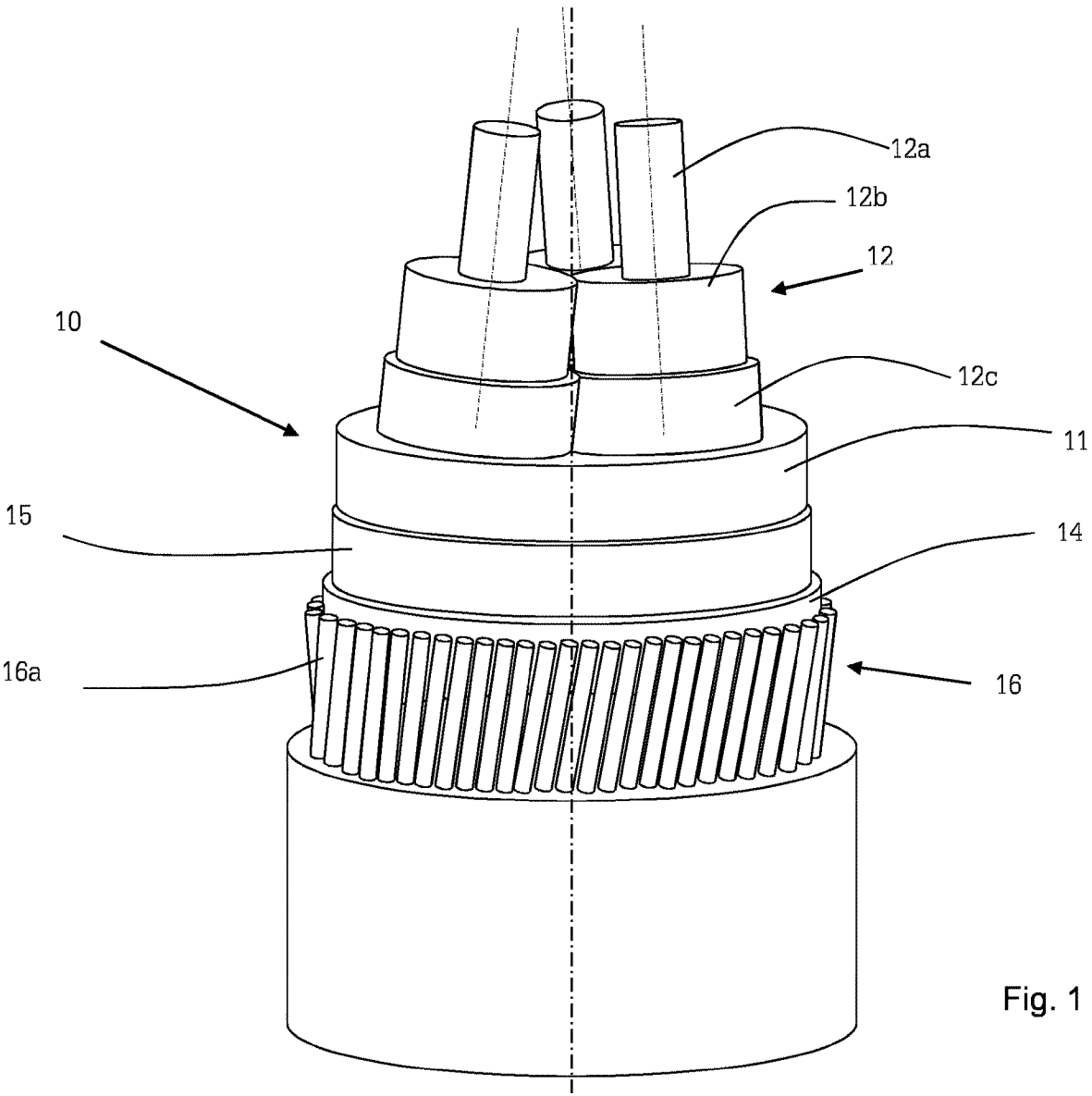

FIG. 1 schematically shows an armoured HVAC cable 10 for submarine application comprising three-phase cores 12. The armoured HVAC cable 10 has a cable length L. The cable length L covers a length between two fixed points. Each fixed point may be, for example, a cable joint or a current generator.

It is noted that even if the HVAC cable 10 shown in the figure and described herein below is a multi-core cable, the teachings of the present disclosure also applies to an armoured HVAC cable comprising a single core, said single core having the same features as anyone of the cores 12 described below.

Each core comprises a metal conductor 12*a* in form of a rod or of stranded wires. The metal conductor 12*a* can, for example, be made of copper, aluminium or both. The conductor 12*a* has a cross section area X, wherein $X=\pi(d/2)^2$, d being the diameter of the conductor 12*a*.

Each metal conductor 12*a* is sequentially surrounded by an insulating system 12*b*. The insulating system 12*b* is made of an inner semiconducting layer, an insulating layer and an outer semiconducting layer, said three layers (not shown) being based on polymeric material (for example, polyethylene or polypropylene), wrapped paper or paper/polypropylene laminate. In the case of the semiconducting layer/s, the polymeric material thereof is charged with conductive filler such as carbon black. The three cores 12 further comprise each metal screen 12*c*. The metal screen 12*c* can be made of lead, generally in form of an extruded layer, or of copper, in form of a longitudinally wrapped foil, of tapes or of braided wires.

The three cores 12 are helically stranded together according to a core stranding pitch A and a core stranding direction.

The three cores 12 are, as a whole, embedded in a polymeric filler 11 surrounded, in turn, by a tape 15 and by a cushioning layer 14. For example, the tape 15 is a polyester or non-woven tape, and the cushioning layer 14 is made of polypropylene yarns.

Around the cushioning layer 14, an armour 16 comprising a single layer of armour wires 16*a* is provided. The wires 16*a* are helically wound around the cable 10 according to an armour winding pitch B and an armour winding direction.

The armour 16 surrounds the three cores 12 together, as a whole.

At least some or all the armour wires 16*a* are made of a ferromagnetic material, which is advantageous in terms of costs with respect to non-ferromagnetic metals like, for example, stainless steel.

The ferromagnetic material can be, for example, carbon steel, martensitic stainless steel construction steel or ferritic stainless steel, optionally galvanized.

Examples of construction steel are Fe 360, Fe 430, Fe 510 according to European Standard EN 10025-2 (2004).

The ferromagnetic wires 16*a* are permanently magnetized by application of an external magnetic field to the HVAC cable 10 as a whole so that a remanent magnetization is retained by ferromagnetic wires 16*a* after the external magnetic field is removed.

When a permanent uniform magnetization is desired, the ferromagnetic wires 16*a* can be magnetized before the provision around the cable core to form the armour.

The operation of permanently magnetization of the ferromagnetic armour wires 16*a* by application of the external magnetic field to the HVAC cable 10 may be performed either during the laying process or manufacturing process of the HVAC cable 10. For example, it may be performed in the factory, at the end of the manufacturing process and before shipping the HVAC cable 10.

In an embodiment, the external magnetic field is applied so as to reach magnetic saturation of the ferromagnetic material of the ferromagnetic wires 16*a*, the magnetic saturation usually differing depending on the ferromagnetic material.

For example, the external magnetic field may be produced by permanent magnets (e.g. rare earth magnets) and applied to the HVAC cable 10 as described by U.S. Pat. No. 6,366,191.

The external magnetic field applied to the ferromagnetic wires 16*a* can be such that a cylindrically symmetric remanent magnetic field along the cable is produced.

The external magnetic field applied to the ferromagnetic wires may be either uniform (i.e. constant) or variable along the cable length L. Accordingly, the remanent magnetization is retained by the ferromagnetic wires after the external magnetic field is removed, with a remanent magnetic field which is respectively uniform or variable along the cable length L. In an embodiment, the remanent magnetic field is periodically variable along the cable length L.

In relation to this disclosure, the Applicant observed that, in case the cable is permanently magnetized so as to produce a remanent magnetic field around the cable, which is uniform (i.e. constant) along the cable length, said remanent magnetic field is hardly detectable at a certain distance from the cable because the magnetic field has flux lines developing along the cable length, parallel to the cable longitudinal axis. On the other side, as shown in FIG. 6 of U.S. Pat. No. 6,366,191, if the cable is permanently magnetized so as to produce a remanent magnetic field around the cable, which periodically varies along the cable length, the magnetic field has radial flux lines F1 that get away from the cable axis, thus making the magnetic field detectable at a certain distance from the cable.

The embodiment with variable remanent magnetic field can permit magnetic localization of the armoured HVAC cable 10 at a certain distance from the object, for example at 3-6 m afar.

In an embodiment, the periodically variable remanent magnetic field has a magnetization pitch, which is greater than the width of the overall diameter of the HVAC cable 10.

The overall diameter of the HVAC cable 10 can be comprised between 100 mm a 300 mm.

In an embodiment, the periodically variable remanent magnetic field has a magnetization pitch, which is substantially the same as the core stranding pitch A.

For example, the periodical variation of the external magnetic field and of the remanent magnetic field is sinusoidal or square waved.

The Applicant tested the effects that permanent magnetization of the armour ferromagnetic wires has on the cable losses.

In a first trial, the Applicant measured the losses generated in a ferromagnetic rod immersed into a variable magnetic field produced by an AC current transported by a solenoid; the solenoid simulating the variable magnetic field produced when an AC current is transported by an AC cable.

Measurements have been performed by arranging the ferromagnetic rod inside the solenoid.

The ferromagnetic rod was straight with a length of 500 mm and a diameter of 6 mm. The ferromagnetic material of the rod was a galvanised low-carbon steel conforming to EN 10257-2 grade 34, EN 10244-2 and ICEA S-93-639 standards.

The solenoid was designed and optimized to generate a magnetic field similar to the one of a real AC three-core cable carrying a nominal current of 800 A, wherein ferromagnetic armour wires are usually immersed in a magnetic field roughly comprised between 30 A/m and 500 A/m.

The solenoid was composed of 183 windings and realized with a flexible copper wire with section of 1.5 $mm^2$: the wire was wounded on transparent plastic pipe with a mean diameter of 123 mm. The total length of the wounded part was exactly 1000 mm. With a circulating AC current of 1 A at 50 Hz, a magnetic field of 183 A/m was computed to be present inside the solenoid, by considering an approximating formula of a solenoid of infinite length for which the magnetic field is determined by the product of current I* turn density, that is 183 turns in 1 meter.

The losses $L_r$ generated in the ferromagnetic rod immersed in the variable magnetic field produced by the AC current transported by the solenoid were measured with the help of a powermeter by:

- measuring the power $P_s$ dissipated in the solenoid alone;
- measuring the power $P_{s+r}$ dissipated in the solenoid when the rod is arranged inside it; and
- obtaining $L_r$ as the difference between $P_{s+r}$ and $P_s$, divided by the square of the current I circulating in the solenoid (i.e., $L_r=(P_{s+r}-P_s)/I^2$).

Figure 2:
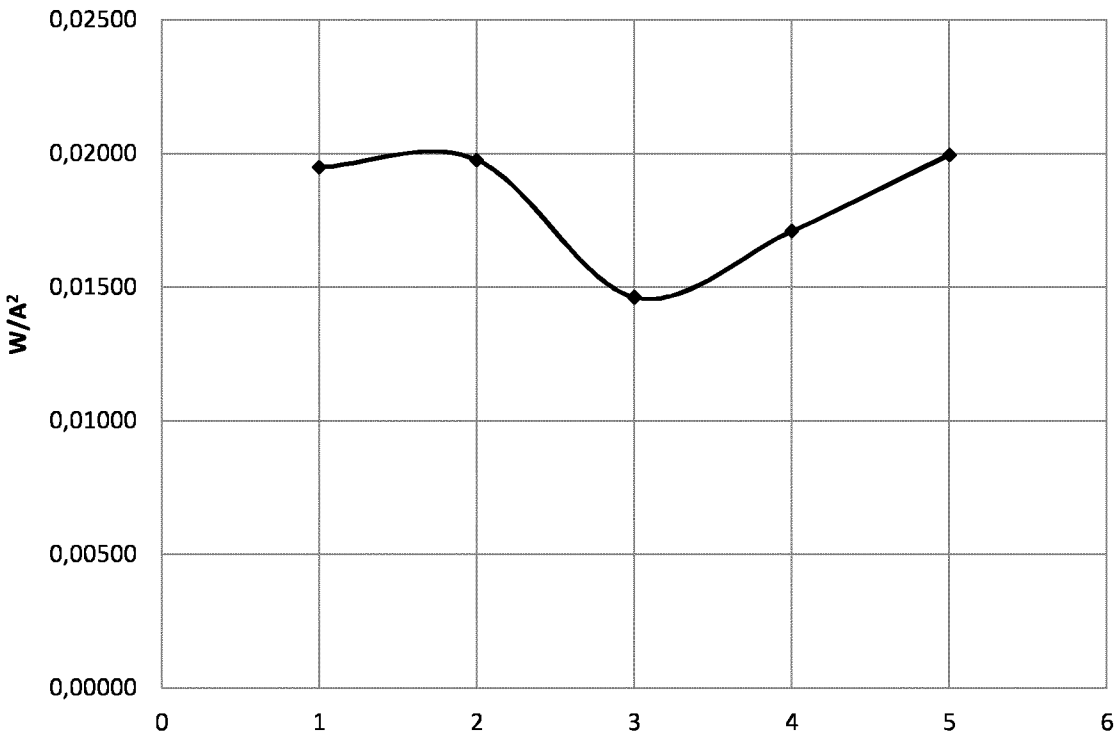
FIG. 2 shows the losses generated in different situations in a ferromagnetic rod immersed in a variable magnetic field produced by an AC current transported by a solenoid arranged around the rod.

FIG. 2 shows the losses $L_r$ (in ordinate, measured in Watt/$A^2$) generated in the ferromagnetic rod in five different test steps (in abscissa):

- in step 1, the losses $L_r$ were measured by using the ferromagnetic rod as purchased (with possible natural magnetization, e.g. due to the earth's magnetic field);
- in step 2, the losses $L_r$ were measured after one month from step 1;
- in step 3, the losses $L_r$ were measured after the ferromagnetic rod of situation 2 was permanently magnetized;
- in step 4, the losses $L_r$ were measured after the ferromagnetic rod magnetized in step 3 was partially demagnetized;
- in step 5, the losses $L_r$ were measured after the ferromagnetic rod of step 4 was completely demagnetized.

In particular, permanent magnetization of the ferromagnetic rod in step 3 was performed by arranging the rod inside another solenoid with a circulating DC current of 1700 A so as to produce an extremely high external magnetic field of about 50.000 A/m (which was far beyond the ferromagnetic material saturation), which was thus applied to ferromagnetic rod to permanently magnetize it.

Demagnetization of the ferromagnetic rod in step 5 was performed by using a further solenoid with a circulating AC current of 10 A at 50 Hz so as to produce a sinusoidally variable external magnetic field of about 50.000 A/m (which was far beyond the ferromagnetic material saturation). Demagnetization of the ferromagnetic rod was obtained by slowly inserting the rod inside the solenoid and passing it twice across the solenoid. While the rod is extracted from the solenoid, it is exposed to a sinusoidally variable external magnetic field that gradually decreases up to a zero value, starting from the very high value of 50.000 A/m. As known in the art, this process enables permanent magnetization of the ferromagnetci material to be completely eliminated.

Partial demagnetization of the ferromagnetic rod in step 4 was performed by using the same process and the same solenoid of step 5 but with a circulating AC current of about 5 A at 50 Hz so as to produce a sinusoidally variable external magnetic field of about 2000 A/m (which was much less than/comparable with the ferromagnetic material saturation).

The effect of demagnetization was empirically tested with the help of iron powder: in step 4 iron power sticked to the rod, meaning that a residual magnetization was still present. On the other side, in steps 2 and 5 iron power didn't stick to the rod, meaning that no residual magnetization was present.

The results of FIG. 2 show that the losses $L_r$ generated in the ferromagnetic rod in step 3, wherein the rod is permanently magnetized, are lower than in all other steps wherein the rod is demagnetized (steps 2 and 5), or partly demagnetized (step 4), or with its natural magnetization (step 1). In particular, in step 3 the losses $L_r$ are reduced by about 25%.

Moreover, comparison of the losses at steps 2 and 5 shows that the losses at step 2 are restored after one or more magnetization-demagnetization cycles. It is thus clear that reduction of losses at step 3 is stritcly linked to permanent magnetization of the rod.

The first investigation performed by the Applicant thus shows that losses generated in a ferromagnetic rod immersed into a variable magnetic field, as produced by an AC current transported by a solenoid arranged around the rod, are reduced when the ferromagtic rod is permanently magnetized.

After the results obtained with the first investigation, the Applicant carried on his reasearch to analyse the effects on cable losses of permanent magnetization of ferromagnetic armour wires.

In particular, in a second investigation, the Applicant studied the losses generated in a sample of an armoured AC cable during a progressive magnetization and demagnetization of the ferromagnetic armour wires of the sample.

In this investigation, the Applicant analyzed an AC cable sample of 8 meters having: three cores stranded together in a contralay configuration according to a S-Z configuration (with S armour winding direction and Z core stranding direction) with a core stranding pitch A of +3000 mm; a single layer of nighty-five (95) wires of galvanized ferritic steel wound around the cable according to a S armour winding direction and an armour winding pitch B of −2000 mm; a crossing pitch C equal to 1200 mm; an external wire diameter d of 7 mm; a cross section area X of 1000 $mm^2$ for a rated voltage of 150 KV; an overall external diameter of the cable of 246 mm; a metal screen of lead with an electrical resistivity of $21.4 \cdot 10^{-8}$ Ohm·m and relative magnetic permeability $\mu_r=1$; and armour wires with an electrical resistivity of $20.8 \cdot 10^{-8}$ Ohm·m and relative magnetic permeability $\mu_r=300$.

Permanent magnetization of the ferromagnetic armour wires has been performed by means of a magnetizing coil.

A flexible cable was used to make the magnetizing coil, with special insulation that can reach 105° C. Small cable diameter means higher turns density and larger magnetic field. The coil was supported by a plastic pipe. A DC power supply was used, capable of giving a very large current, up to 2000 A, but with a relatively small voltage of 16 V. For these reasons, 5 conductors have been connected in parallel inside the cable and the same has been done for three layers of turns making the coil.

Other characteristics of the magnetizing coil are:

External diameter of the plastic pipe used for supporting the coil: 315 mm;

Cable used to make the coil: 5 copper conductors connected in parallel, each conductor having a cross section area of 4 $mm^2$;

Total length of the flexible cable: 51 m;

Total number of turns: 48;

Total circulating current: 1370 A.

The detailed description of the coil is reported in Table 1 below.

TABLE 1

| | Unit | Internal layer | Central layer | External layer |
|---|---|---|---|---|
| Cable diameter | mm | 12 | 12 | 12 |
| Number of turns | N° | 17 | 16 | 15 |
| Mean diameter of the turns | m | 0.327 | 0.339 | 0.351 |
| Layer length along the cable | m | 0.22 | 0.205 | 0.19 |
| Current in the layer | A | 445 | 455 | 470 |
| Voltage drop | V | 7.9 | 7.9 | 7.9 |
| Magnetic field for infinite solenoid | kA/m | 34.4 | 35.5 | 37.1 |
| Magnetic field of real solenoid | kA/m | 18.7 | 17.9 | 17.2 |

The total magnetic field computed with infinitely long solenoid approximation resulted to be 107 kA/m. The total magnetic field computed for the real solenoid resulted to be 53.8 kA/m.

On the other side, the magnetic field effectively measured by a probe inside the magnetizing coil, in void conditions, was 50.3 kA/m, in good agreement with the computed value for the real solenoid.

A static magnetic field of 50 kA/m was far beyond the ferromagnetic material saturation and sufficient to induce permanent magnetization into the ferromagnetic wires of the armour.

Operated in the above way, the 1370 A circulating current heated up the magnetizing coil at a rate of about 1K per second, due to the large current in a relatively small conductor and mutual heating between the various turns. Thermal rise that can be admissible for the cable is up to 105° C., but maximum temperature has to be limited to around 80° C., to avoid softening of the plastic support. Operation time was thus limited to 30 seconds, followed by at least 10 minutes off and check of the temperature of the cable.

Permanent magnetization of the armour wires of the AC cable sample was performed by arranging the plastic pipe supporting the magnetizing coil around a starting end of the AC cable sample. Then, taking into account said operation time, the magnetizing coil was energised and moved along the cable to progressively permanently magnetize subsequent sections of the armour wires, starting from the starting end up to an opposite end of the AC cable sample. When the magnetizing coil reached the opposite end, about 90% of the cable armour was completely magnetised (part of the extremities of the sample were not accessible with the coil).

While the cable armour was progressively magnetized, the cable losses were progressively measured, as shown in FIG. 3.

Then, after the cable armour was completely magnetized, it was demagnetized by means of a demagnetizing coil.

A flexible cable was used to make the demagnetizing coil, with special insulation that can reach 105° C. Also in this case, small diameter means higher turns density and larger magnetic field. The demagnetizing coil was supported by a plastic pipe. An AC power supply was used, capable of giving a voltage up to 140 V, but with current limited to 7 A. For these reasons, the 4 conductors have been connected in series inside the cable and the same has been done for five layer of turns making the demagnetizing coil.

Other characteristics of the demagnetizing coil are:

External diameter of the plastic pipe used to support the demagnetizing coil: 315 mm;

Total length of cable used: 67 m;

Cross section area of each of the 4 conductors connected in series: 6 $mm^2$;

Total number of turns: 292;

Total circulating current: 4.27 A at 50 Hz;

The detailed description of the demagnetizing coil is reported in Table 2 below.

TABLE 2

| | Unit | Internal layer | Semi-internal layer | Central layer | Semi-external layer | External layer |
|---|---|---|---|---|---|---|
| Cable diameter | mm | 12 | 12 | 12 | 12 | 12 |
| Number of turns | No | 17 | 16 | 15 | 14 | 11 |
| Mean diameter of the turns | m | 0.327 | 0.339 | 0.351 | 0.363 | 0.375 |
| Layer length | m | 0.250 | 0.235 | 0.200 | 0.185 | 0.150 |
| Current in the layer | A | 4.27 | 4.27 | 4.27 | 4.27 | 4.27 |
| Mag field for infinite solenoid | kA/m | 1.16 | 1.16 | 1.28 | 1.29 | 1.25 |
| Mag field for real solenoid | kA/m | 0.69 | 0.65 | 0.62 | 0.57 | 0.45 |

The total magnetic field computed with infinitely long solenoid approximation was 6.15 kA/m. The total magnetic field computed with with real solenoid was 2.98 kA/m.

On the other side, the magnetic field effectively measured by a probe inside the coil, in void conditions, was 2.92 kA/m, in good agreement with the computed value for the real solenoid.

Demagnetization of the armour of the AC cable sample was performed by arranging the plastic pipe supporting the demagnetizing coil around a starting end of the AC cable sample. The coil was then energised and moved along the cable to progressively demagnetize subsequent sections of the armour, starting from the starting end up to an opposite end of the AC cable sample. While the coil was moved along the different sections of the AC cable sample, each section was exposed to a sinusoidally variable external magnetic field that gradually decreased to zero as the distance between the cable section and the coil increased. As stated above, this process enables permanent magnetization of the ferromagnetci material of the armour wires to be eliminated.

While the cable armour was progressively demagnetized, the cable losses were progressively measured, as shown in FIG. 3.

In particular, FIG. 3 reports the values of the relative phase resistance (i.e. the total losses of the AC cable sample referred to the nominal AC cable current, relative to the total losses of the non-magnetized AC cable sample) measured during progressive magnetization (solid line) and demagnetization (dashed line) of armour sections of the AC cable sample along a length of 8 m. The relative phase resistance was measured by circulating a nominal AC current of 800 A at 50 Hz into the AC cable.

In FIG. 3, continuous line shows the relative phase resistance (in ordinate) of the AC cable referred to the position of the magnetizing coil starting from a starting end at a position of zero meters (non-treated sample) up to an opposite end of the cable sample at about 8 meters (in abscissa).

On the other side, dashed line shows the relative phase resistance of the AC cable referred to the position of the demagnetizing coil starting from a starting end at a position of about 8 meters up to an opposite end of the cable sample at zero meters.

FIG. 3 shows that:

- permanent magnetization progressively reduces the relative phase resistance (i.e. the total cable losses) at increasing magnetized length of the armour (continuous line from 0 to 8 m);
- when the whole sample is permanently magnetized (continuous line, 8 meters position), a reduction of the total cable losses of more than 1% is obtained;
- demagnetization progressively restores the relative phase resistance up to the original value measured before magnetization, for increasing demagnetized length of the armour (dashed line from 8 to 0 m).
- the relative phase resistance returns almost exactly (the difference in FIG. 3 being linked to measuring uncertainties) to the original value when the AC cable is completely demagnetised; this demonstrates that the measured losses reduction is effectively due to permanent magnetization of armour wires and means that demagnetization performed with an external magnetic field of about 2.9 kA/m (much higher than the magnetic field generated by the AC current in nominal conditions, which is roughly comprised between 30 A/m and 500 A/m, wholly eliminates the permanent magnetization previously generated into the armour wires;
- the relative phase resistance is quite linear with the treated length of the cable sample.

It is further noted that the measured relative phase resistance resulted to be constant with time for various measures performed at 8 m (measures not reported in the graph of FIG. 3). This means that permanent magnetization persisted with time and was not affected by the variable magnetic field generated by the nominal AC current transported by the AC cable sample (which is generally comprised between 30 A/m and 500 A/m). In other words, the permanent magnetization generated into the armour of the AC cable is permanent and the variable magnetic field generated by the nominal AC current transported by the AC cable sample does not modify it.

The second investigation performed by the Applicant thus shows that cable losses are reduced (by more than 1%) when the ferromagnetic wires of the AC cable armour are permanently magnetized; said reduction being stable with time nothwithstanding the AC current transported by the AC cable.

In a third investigation, the Applicant analysed how eddy currents $I_{screen}$, generated in the metal screen of the AC cable by the AC current $I_{conductor}$ trasported by the AC cable conductors, are affected by permanent magnetization of the armour wires.

FIG. 4 reports, in ordinate, the value of the ratio $I_{screen}/I_{conductor}$, measured in the same way as reported for FIG. 3, with respect to the length of magnetized (solid line) or demagnetized (dashed line) cable length (in abscissa). This ratio is directly linked to the losses of the cable (in particular to the losses due to eddy currents in the metal screen), because the higher the ratio, the higher the eddy currents in the screen and therefore the screen losses and cable losses. FIG. 4 shows that:

- permanent magnetization progressively reduces the ratio $I_{screen}/I_{conductor}$ (i.e. the total cable losses and, in particular, screen losses) for increasing magnetized length of the armour (continuous line from 0 to 8 m);

when the whole sample is permanently magnetized (solid line, 8 meters position), a reduction of the ratio $I_{screen}/I_{conductor}$ of about 0.3% is obtained;

demagnetization progressively restores the ratio $I_{screen}/I_{conductor}$ up to the original value measured before magnetization, for increasing demagnetized length of the armour (dashed line from 8 to 0 m).

the ratio $I_{screen}/I_{conductor}$ returns almost exactly (the difference in FIG. 4 being linked to measuring uncertainties) to the original value when the AC cable is completely demagnetised;

the ratio $I_{screen}/I_{conductor}$ is quite linear with the treated length of the cable sample.

In view of the above, it will be clear that permanent magnetization of the ferrognatic armour wires reduces the cable losses, including both armour losses and screen losses.

As stated above, the reduction of cable losses leads to two improvements in an AC transport system: increasing the current transported by a cable and/or providing a cable with a reduced cross section area X. This is very advantageous because it enables to make a cable more powerful and/or to reduce the size of the conductors with consequent reduction of cable size, weight and cost.

The armoured cable of the present disclosure is, thus, built with a reduced value of the cross section area X of the electric conductor, as determined by the value of the reduced losses.

In alternative or in combination, the armoured cable of the present disclosure is rated at the maximum allowable working conductor temperature θ to transport an alternate current I with an increased value, as determined by the value of the reduced losses. In particular, the armoured cable of the present disclosure can be operated at the maximum allowable working conductor temperature θ so as to transport an alternate current I with an increased value, as determined by the value of the reduced losses.

The armoured cable of the present disclosure can be operated with an increased value of the transported current and/or can be built with a reduced cross section area X, with respect to what calculated on the basis of the IEC 60287 recommendations for an AC cable, wherein magnetic properties of the armour wires are not taken into account.

For example, the value of the transported current and/or the value of the cross section area X can be determined by considering as a reference point the result obtained with reference to FIG. 3 and reckoning cable losses reduced by 1%, with respect to what calculated on the basis of the IEC 60287 recommendations for an AC cable.

More in general, starting from the result of FIG. 3, a person skilled in the art, willing to design an armoured AC cable according to the present disclosure and to exploit the cable losses reduction obtained thanks to a permanent magnetization of the ferrognatic armour wires, will be able to reckon a proper percentage of cable losses reduction (for example, within a range of 0.5-5%), depending on the nominal conductor/s cross section and the ferromagnetic properties of the material used for the armour wires. In particular, the person skilled in the art, having at his disposal the means and the capacity for routine work and experimentation, which are normal for the technical field in question, will have the skill to perform laboratory cable losses measures on samples of different types of model cables and to use the results of said measures as useful reference points for designing an armoured AC cable according to the present disclosure.

According to an embodiment of the present disclosure, the HVAC cable 10 is such that at least one of the core stranding direction and the armour winding direction is recurrently reversed along the cable length L so that the HVAC cable 10 comprises unilay sections along the cable length L wherein the core stranding direction and the armour winding direction are the same.

FIG. 5 schematically shows an embodiment wherein the core stranding direction 21 is regularly reversed along the cable length so that the cores are alternately stranded together according to a right-handed (or clockwise) direction Z (Z-lay) and a left-handed (or counterclockwise) direction S (S-lay). This alternated laying configuration is hereinafter called S/Z configuration. On the other side, the armour winding direction 22 is unchanged along the cable length. In particular, in the embodiment shown, the armour winding direction 22 is left-handed S. In this way, the cable comprises unilay sections 102 along the cable length L wherein the core stranding direction 21 and the armour winding direction 22 are the same (in the embodiment shown, they are both S). The cable also comprises contralay sections 101 along the cable length L wherein the core stranding direction 21 and the armour winding direction 22 are the opposite. In particular, in the embodiment shown, the core stranding direction 21 is Z while the armour winding direction 22 is S.

FIG. 6 schematically shows another embodiment wherein the armour winding direction 22 is regularly reversed along the cable length L so that the armour wires are alternately stranded together according to a right-handed (or clockwise) direction Z and a left-handed (or counterclockwise) direction S. On the other side, the core stranding direction 21 is unchanged along the cable length L. In particular, in the embodiment shown, the core stranding direction 21 is right-handed Z. In this way, the cable comprises unilay sections 102 along the cable length L wherein the core stranding direction 21 and the armour winding direction 22 are the same (that is, in the embodiment shown, they are both Z). The cable also comprises contralay sections 101 along the cable length L wherein the core stranding direction 21 and the armour winding direction 22 are the opposite. In particular, in the embodiment shown, the core stranding direction 21 is Z while the armour winding direction 22 is S.

FIG. 5 shows an embodiment wherein the number N of turns 21*a* of the cores in a Z section (that is, a section of the cable length L with a Z core stranding direction 21) and the number M of turns 21*b* of the cores in a S section (that is, a section of the cable length with a S core stranding direction 21) are equal to each other (in the example, N=M=4).

Analogously, FIG. 6 shows an embodiment wherein the number N of turns 22*a* of the armour wires in a Z section (that is, a section of the cable length L with a Z armour winding direction 22) and the number M of turns 22*b* of the armour wires in a S section (that is, a section of the cable length with a S armour winding direction 22) are equal to each other (in the example, N=M=4).

The case on N=M can be advantageous in terms of mechanical construction of the cable.

However, the teachings of the present disclosure invention also apply to the case wherein N is different from M.

Moreover, N and M can be either integer or decimal numbers. N and/or M can be the same (i.e. unchanged) along the cable length L (as shown in FIGS. 5 and 6) or vary (when N has different values in different S sections and M has different values in different Z sections).

For example, N is greater than 2.5 and lower than 4.

For example, M is greater than 2.5 and lower than 4.

FIGS. 5 and 6 schematically show examples wherein the core stranding pitch A and the armour winding pitch B are, in modulus, equal to each other and unchanged along the cable length. However, the core stranding pitch A and the armour winding pitch B can be different from each other (in sign and/or absolute value) in order to avoid drawbacks in terms of mechanical strength of the cable.

Moreover, the core stranding pitch A and/or the armour winding pitch B can vary along the cable length.

For example, in an embodiment (not shown) of the present disclosure, the armour winding pitch B in the contralay sections 101 is greater, in modulus, than the armour winding pitch B in the unilay sections 102. As disclosed by U.S. Pat. No. 9,431,153 (in the name of the same Applicant), a higher value of B, in modulus, advantageously enables to limit the armour losses in the contralay sections 101 (the armour losses in the unilay sections 102 being already reduced by the unilay configuration per se).

Further details about the values of A and B are disclosed, for example, by U.S. Pat. No. 9,431,153, the disclosure of which is herein incorporated by reference.

As disclosed by U.S. Pat. No. 9,431,153, armour losses are highly reduced when the armour winding pitch B is unilay to the core stranding pitch A, compared with the situation wherein the the armour winding pitch B is contralay to the core stranding pitch A. The armour losses have a minimum when core stranding pitch A and armour winding pitch B are equal (unilay cable with cores and armour wire with the same pitch) while they are very high when B is close to zero (positive or negative). In addition, an increase of armour winding pitch B—either unilay or contralay with respect to core stranding pitch A—brings to reduction of the armouring losses. As disclosed by U.S. Pat. No. 9,431,153, in order to reduce losses, the armour winding pitch B is higher than 0.4 A.

Moreover, as disclosed by PCT/EP2017/059482 (in the name of the same Applicant), the embodiment of FIGS. 5 and 6, wherein contralay sections 101 alternate with unilay sections 102, enables, on the one side, to reduce cable losses with respect to a whole contralay configuration and, on the other side, to improve the mechanical performances of the cable, especially during laying operations, with respect to a whole unilay configuration.

In order to guarantee a good compromise between the two conflicting needs of increasing the permissible current rating I (and reducing the cable losses) and improving the mechanical stability of the cable, the armoured HVAC cable 10 has 20-80% of unilay sections, for example 30-70% or 40-60%, along the cable length. As disclosed by PCT/EP2017/059482, these values advantageously enable to obtain an increase in permissible current rating I, with respect to a whole contralay cable, of 0.88%-3.63%, 1.32%-3.19%, 1.87%-2.75%, respectively.

Moreover, the percentage of unilay sections can be attained by regularly arranging the unilay sections along the cable length L (regularly alternated with contralay sections) in order to avoid a cable configuration having a too long contralay section (e.g. covering a first half of the cable) followed by a too long unilay section (e.g. covering the second half of the cable). This latter solution would be disadvantageous both in mechanical terms (because the advantage of having alternating contralay and unilay sections is reduced) and electrical terms (because a potentially harmful voltage of a significant level can build up at the end of a long section that may be dangerous in submarine cables in case of water seepage).

According to this disclosure, in the embodiment of FIGS. 5 and 6, wherein contralay sections 101 alternate with unilay sections 102, the armour wires 16*a* of the HVAC cable 10 are permanently magnetized with a remanent magnetic field, which is either uniform or variable along the cable length L, in an embodiment periodically variable.

When the remanent magnetic field is periodically variable along the cable length L, the ferromagnetic armour wires 16*a* can be permanently magnetized so that inversion points of the periodically variable remanent magnetic field fall in said unilay sections 102, for example substantially at the centre of said unilay sections 102. This is advantageous considering that, at every inversion point of the variable remanent magnetic field, the permanent magnetization is substantially reduced to zero, so that its beneficial effects on losses reduction are nullified at said inversion points. It is thus advantageous to have the inversion points at the unilay sections 102 wherein, as disclosed by U.S. Pat. No. 9,431,153 and PCT/EP2017/059482, the armour losses are lower than in the contralay sections 101. In this way, full benefit of losses reduction, due to the permanent magnetization of the ferromagnetic armour wires 16*a*, is obtained in the contralay sections 101.

For example, the remanent magnetic field has a periodic variation along the cable length L with a magnetization pitch which is substantially the same as the core stranding pitch A.

Regarding total losses for capitalisation, in the embodiments of FIGS. 5 and 6, they are computed as an average value of dissipated power per length unit (W/m) due to armour and screen losses in the contralay sections and unilay sections, weighted over the length covered by the contralay sections and the unilay sections. As the (armour and screen) losses in the unilay sections are lower than in the contralay sections, the total losses for capitalisation in the cable according to such embodiments are reduced with respect to that of a whole contralay cable. Moreover, according to the present disclosure, the (armour and screen) losses in the contralay sections are further reduced thanks to the permanent magnetization of the ferromagnetic armour wires 16*a*.

The invention claimed is:

1. Method for improving the performances of an armoured AC cable having a cable length L and cable losses when an alternate current I is transported, the armoured AC cable comprising at least one core comprising an electric conductor having a cross section area X sized for operating the armoured AC cable to transport an alternate current I at a maximum allowable working conductor temperature θ, as determined by the cable losses; the armoured AC cable further comprising an armour, surrounding the at least one core and comprising ferromagnetic wires; the method comprising the steps of:

reducing the cable losses by permanently magnetizing said ferromagnetic wires so as to generate in the ferromagnetic wires a remanent magnetic field;

sizing the cross section area X of each electric conductor with a reduced value, this reduced value being determined and made possible by the value of the reduced cable losses, and/or rating the armoured AC cable at the maximum allowable working conductor temperature θ to transport said alternate current I with an increased value, this increased value being determined and made possible by the value of the reduced cable losses.

2. The method for improving the performances of an armoured AC cable according to claim 1, wherein the AC cable is a high voltage AC cable having a diameter ranging from 100 mm to 300 mm.

3. The method for improving the performances of an armoured AC cable according to claim 1, wherein the remanent magnetic field is uniform along the cable length L.

4. The method for improving the performances of an armoured AC cable according to claim 1, wherein the remanent magnetic field is variable along the cable length L.

5. The method for improving the performances of an armoured AC cable according to claim 1, wherein the at least one core comprises two or more cores stranded together according to a core stranding direction, and wherein the ferromagnetic wires are helically wound around the cores according to an armour winding direction, and the core stranding direction and the armour winding direction are unilay.

6. The method for improving the performances of an armoured AC cable according to claim 1, wherein the at least one core comprises two or more cores stranded together according to a core stranding direction, and wherein the ferromagnetic wires are helically wound around the cores according to an armour winding direction, and wherein at least one of the core stranding direction and the armour winding direction is recurrently reversed along the cable length L so that the armoured cable comprises unilay sections along the cable length L.

7. The method for improving the performances of an armoured AC cable according to claim 6, wherein the remanent magnetic field is variable along the cable length L so that inversions of the variable remanent magnetic field fall in the unilay sections.

8. The method for improving the performances of an armoured AC cable according to claim 1, wherein the step of permanently magnetizing the ferromagnetic wires is carried out by applying an external magnetic field to an extent such as to reach magnetic saturation of the ferromagnetic wires.

9. Method for improving the performances of an armoured AC cable having cable losses and comprising at least one core comprising an electric conductor, and an armour surrounding the at least one core, the armour comprising ferromagnetic wires, the method comprising:

reducing the cable losses by permanently magnetizing the ferromagnetic wires so as to generate in the wires a remanent magnetic field.

10. The method for improving the performances of an armoured AC cable according to claim 9, wherein the AC cable is a high voltage AC cable having a diameter ranging from 100 mm to 300 mm.

11. The method for improving the performances of an armoured AC cable according to claim 9, wherein the remanent magnetic field is uniform along a cable length L.

12. The method for improving the performances of an armoured AC cable according to claim 9, wherein the remanent magnetic field is variable along a cable length L.

13. The method for improving the performances of an armoured AC cable according to claim 9, wherein the at least one core comprises two or more cores stranded together according to a core stranding direction, and wherein the ferromagnetic wires are helically wound around the cores according to an armour winding direction, and the core stranding direction and the armour winding direction are unilay.

14. The method for improving the performances of an armoured AC cable according to claim 9, wherein the at least one core comprises two or more cores stranded together according to a core stranding direction, and wherein the ferromagnetic wires are helically wound around the cores according to an armour winding direction, and wherein at least one of the core stranding direction and the armour winding direction is recurrently reversed along a cable length L so that the armoured cable comprises unilay sections along the cable length L.

15. The method for improving the performances of an armoured AC cable according to claim 14, wherein the remanent magnetic field is variable along the cable length L so that inversions of the variable remanent magnetic field fall in the unilay sections.

16. The method for improving the performances of an armoured AC cable according to claim 9, wherein the step of permanently magnetizing the ferromagnetic wires is carried out by applying an external magnetic field to an extent such as to reach magnetic saturation of the ferromagnetic wires.

* * * * *